US011465868B2

(12) United States Patent
Hamano et al.

(10) Patent No.: US 11,465,868 B2
(45) Date of Patent: Oct. 11, 2022

(54) TRANSPORT DEVICE, RECORDING DEVICE, AND MEDIUM TRANSPORT METHOD

(71) Applicant: SEIKO EPSON CORPORATION, Tokyo (JP)

(72) Inventors: Ryo Hamano, Matsumoto (JP); Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 628 days.

(21) Appl. No.: 16/555,841

(22) Filed: Aug. 29, 2019

(65) Prior Publication Data

US 2020/0071113 A1 Mar. 5, 2020

(30) Foreign Application Priority Data

Aug. 31, 2018 (JP) ..... JP2018-162583

(51) Int. Cl.

| | |
|---|---|
| ***B65H 23/198*** | (2006.01) |
| ***B65H 23/195*** | (2006.01) |
| ***B41J 11/42*** | (2006.01) |
| ***B65H 59/38*** | (2006.01) |
| ***B41J 15/16*** | (2006.01) |

(52) U.S. Cl.

CPC ..... *B65H 23/1955* (2013.01); *B41J 11/42* (2013.01); *B41J 15/165* (2013.01); *B65H 59/38* (2013.01)

(58) Field of Classification Search

CPC ..... B65H 23/185; B65H 23/198; B65H 23/1806; B65H 23/1825; B65H 23/1955; B65H 59/38; B41J 11/42; B41J 15/165

See application file for complete search history.

(56) References Cited

U.S. PATENT DOCUMENTS

| | | | | |
|---|---|---|---|---|
| 8,801,137 | B2 * | 8/2014 | Yoshida | B41J 15/04 347/105 |
| 9,056,503 | B2 * | 6/2015 | Yoshida | B41J 15/04 |
| 2015/0329310 | A1 | 11/2015 | Hayashi | |
| 2016/0225196 | A1 * | 8/2016 | Oda | G07C 5/008 |
| 2017/0266999 | A1 * | 9/2017 | Hamano | B41J 13/0036 |
| 2017/0267001 | A1 * | 9/2017 | Hayashi | B65H 23/1825 |
| 2017/0275119 | A1 * | 9/2017 | Hamano | B65H 23/195 |
| 2017/0275130 | A1 * | 9/2017 | Hamano | B65H 23/16 |
| 2017/0282605 | A1 * | 10/2017 | Yoshida | B41J 13/0009 |
| 2019/0193975 | A1 * | 6/2019 | Hamano | B65H 23/18 |

FOREIGN PATENT DOCUMENTS

| | | |
|---|---|---|
| JP | 2015-231910 | 12/2015 |
| JP | 2016-164729 | 9/2016 |

* cited by examiner

*Primary Examiner* — Sang K Kim

(74) *Attorney, Agent, or Firm* — Workman Nydegger

(57) ABSTRACT

A control device of a transport device includes a control unit configured to control a roll motor for rotating a first rotary shaft on which a medium is held and a transport motor for rotating a first driving roller, a tension detection unit configured to derive, for each tension detection cycle, a detected tension value of a tension applied to a tension adjustment portion of the medium, and a tension F/B unit configured to calculate a tension F/B correction amount by feedback control based on a deviation between a target tension and the detected tension value. The control unit is configured to calculate a driving force by the roll motor based on the tension F/B correction amount, and control the roll motor based on the driving force.

8 Claims, 6 Drawing Sheets

TRANSPORT DEVICE, RECORDING DEVICE, AND MEDIUM TRANSPORT METHOD

The present application is based on, and claims priority from JP Application Serial Number 2018-162583, filed Aug. 31, 2018, the disclosure of which is hereby incorporated by reference herein in its entirety.

BACKGROUND

1. Technical Field

The present disclosure relates to a transport device for unwinding a medium from a roll body and transporting the medium, a recording device for performing recording onto the medium transported by the transport device, and a medium transport method in the transport device.

2. Related Art

JP-A-2015-231910 describes an example of a recording device for unwinding a medium from a roll body and performing recording onto the medium. The recording device includes a holding unit configured to rotatably hold the roll body, and a transport unit configured to unwind the medium from the roll body for each predetermined transport cycle. The transport unit operates to feed the medium unwound from the roll body, downstream in the transport direction.

Furthermore, the recording device described in JP-A-2015-231910 is configured to suppress fluctuation of a tension applied to the medium between the roll body and the transport unit. Specifically, the tension applied to the medium between the roll body and the transport unit is detected multiple times per transport cycle. Thus, in the recording device, an average value of the tension applied to the medium between the roll body and the transport unit in a previous transport cycle is calculated, and the detected tension value in the previous transport cycle is calculated based on the average value. Further, in the following transport cycle, a target tension, being a target value of the tension, is calculated based on the detected tension value for the previous transport cycle, and the operation of the transport unit is controlled based on the target tension.

When a significant amount of the medium is transported in a single transport cycle, the tension applied to the medium between the roll body and the transport unit may significantly fluctuate during the single transport cycle. When the tension significantly fluctuates during a single transport cycle, as described above, sufficient tension control in a single transport cycle cannot be provided in the recording device in which a target tension for the current transport cycle is calculated based on a detected tension value for the previous transport cycle and the transport unit is controlled based on the target tension.

SUMMARY

A transport device for solving the at least one of above-described problems includes a holding unit configured to rotatably hold a roll body formed by winding a medium, a rotary driving unit configured to impart, to the holding unit, a driving force in a rotation direction of the roll body, a transport unit disposed downstream from the holding unit in a transport direction of the medium, the transport unit being configured to feed, downstream in the transport direction and for each predetermined transport cycle, the medium unwound from the roll body, a transport driving unit configured to drive the transport unit, a control unit configured to control the rotary driving unit and the transport driving unit, a tension detection unit configured to derive, for each tension detection cycle that is shorter than the transport cycle, a detected tension value that is a tension applied to a portion of the medium between the holding unit and the transport unit, and a tension feedback unit configured to calculate, each time the detected tension value is detected, a tension feedback correction amount by feedback control based on a deviation between the detected tension value and a target tension that is a target value of the detected tension value. In the transport device, the control unit is configured to calculate, for each tension detection cycle, a driving force by the rotary driving unit based on the tension feedback correction amount to control the rotary driving unit based on the driving force by the rotary driving unit.

A recording device for solving the at least one of above-described problems includes the above-described transport device and a recording unit configured to perform recording onto a portion of the medium transported by the transport device, the portion being located downstream from the transport unit in the transport direction.

A medium transport method for solving the at least one of above-described problems includes prividing, a transport device including a holding unit configured to rotatably hold a roll body formed by winding a medium, a rotary driving unit configured to impart, to the holding unit, a driving force in a rotation direction of the roll body, a transport unit disposed downstream from the holding unit in a transport direction of the medium, the transport unit being configured to feed the medium, unwound from the roll body, downstream in the transport direction for each predetermined transport cycle, and a transport driving unit configured to drive the transport unit, deriving, for each tension detection cycle that is shorter than the transport cycle, a detected tension value that is a tension applied to a portion of the medium between the roll body and the transport unit, calculating, each time the detected tension value is derived, a tension feedback correction amount by feedback control based on a deviation between the detected tension value and a target tension that is a target value of the detected tension value, and calculating, for each tension detection cycle, a driving force by the rotary driving unit based on the tension feedback correction amount to drive the rotary driving unit based on the driving force by the rotary driving unit.

DESCRIPTION OF EXEMPLARY EMBODIMENTS

An embodiment of a transport device, a recording device, and a medium transport method will be described below in accordance with FIGS. 1 to 9.

Figure 1:
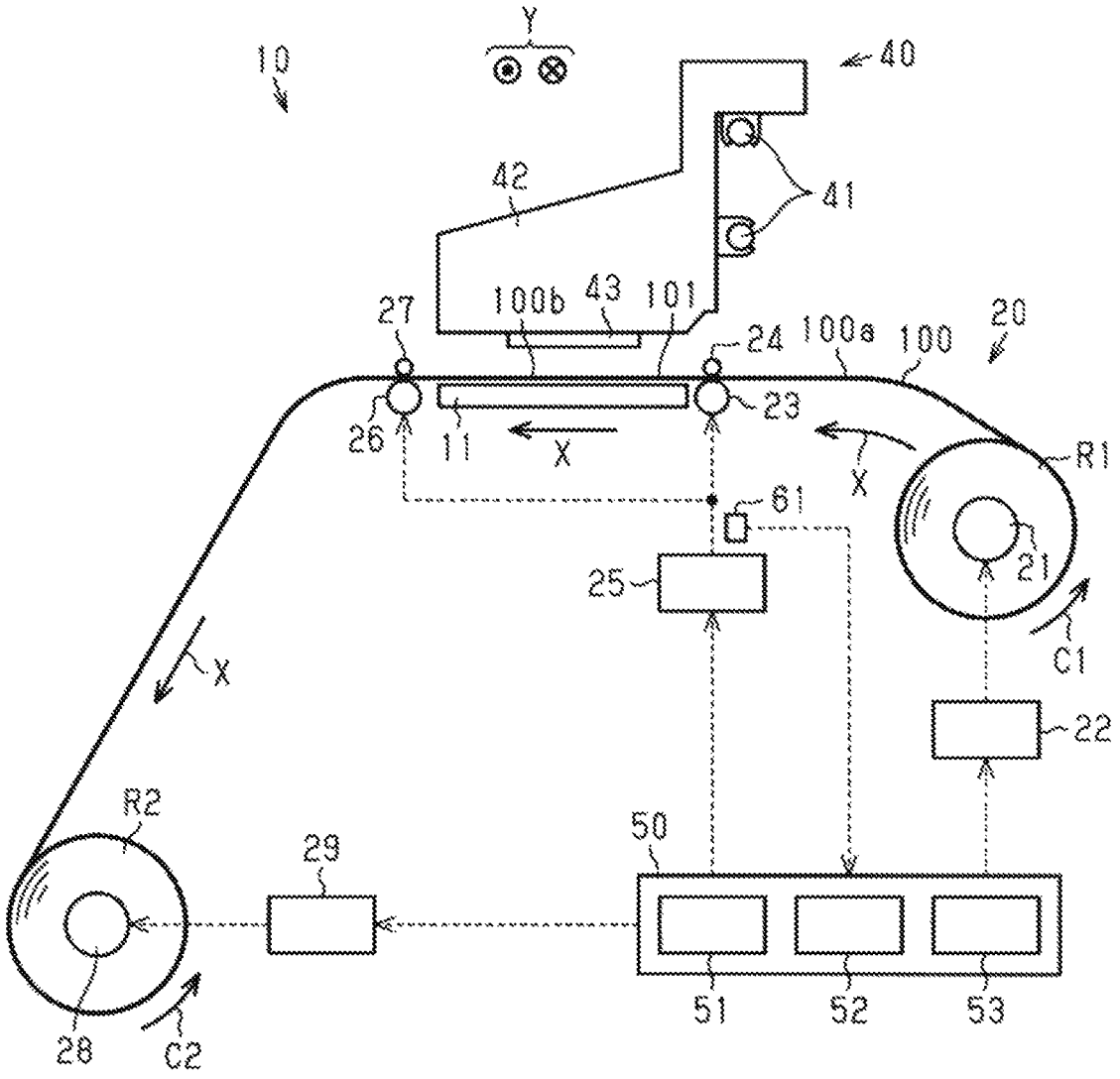
FIG. 1 is a schematic configuration diagram of a recording device according to an embodiment.

As illustrated in FIG. 1, a recording device 10 according to the embodiment is an ink-jet printer configured to record an image on a medium 100 by depositing ink being an example of a liquid onto the medium 100 such as paper. The recording device 10 includes a transport device 20 configured to transport the medium 100 in the transport direction X, and a record unit 40 configured to record an image on the medium 100 transported by the transport device 20. The record unit 40 is an example of a "recording unit".

A support 11 is configured to support a portion of the medium 100 transported by the transport device 20, and the record unit 40 is configured to record an image on a recording surface 101 of the supported portion of the medium 100. The record unit 40 includes a guide member 41 extending along a scanning axis Y, and a carriage 42 supported by the guide member 41. The scanning axis Y runs along a direction intersecting the transport direction X and along the recording surface 101 of the medium 100 supported by the support 11. The carriage 42 is supported on the guide member 41 such that the carriage 42 can move along the scanning axis Y. The carriage 42 includes a recording head 43 configured to discharge ink droplets. The record unit 40 records an image on the recording surface 101 of the medium 100 by discharging ink droplets from the recording head 43 toward the medium 100 while the carriage 42 moves along the scanning axis Y.

As illustrated in FIG. 1, the medium 100 to be transported by the transport device 20 is roll paper being an example of an elongate medium. The transport device 20 includes a first rotary shaft 21 configured to rotatably hold a roll body R1 formed by an unrecorded medium 100 being wound into a cylindrical shape, and a roll motor 22 being a power source for rotating the first rotary shaft 21. When the roll motor 22 applies a driving force to the first rotary shaft 21 to rotate the roll body R1 in a feeding direction C1, the medium 100 is fed from the roll body R1. Thus, in the embodiment, the first rotary shaft 21 corresponds to an example of the "holding unit", and the roll motor 22 corresponds to an example of the "rotary driving unit".

A first driving roller 23 and a first driven roller 24 configured to sandwich the medium 100 against the first driving roller 23 are disposed between the first rotary shaft 21 and the support 11 in the transport direction X of the medium 100. The first driving roller 23 rotates as the driving force by a transport motor 25 is input. Thus, in the embodiment, the first driving roller 23 and the first driven roller 24 correspond to an example of the "transport unit" disposed downstream from the first rotary shaft 21 in the transport direction X of the medium 100. Further, the transport motor 25 corresponds to an example of the "transport driving unit" being the power source for the first driving roller 23.

The transport motor 25 is provided with a speed sensor 61 configured to detect a rotational speed Vtm of the output shaft of the transport motor 25. An output signal of the speed sensor 61 is output to a control device 50 in the recording device 10.

A second driving roller 26 and a second driven roller 27 configured to sandwich the medium 100 against the second driving roller 26 are disposed downstream from the support 11 in the transport direction X of the medium 100. The second driving roller 26 rotates as the driving force by the transport motor 25 is input. Note that, there may be another motor, which is not the transport motor 25, serving as a power source for the second driving roller 26, as long as the other motor can rotate the second driving roller 26 in synchronization with the first driving roller 23.

A second rotary shaft 28 is provided downstream from the second driving roller 26 and the second driven roller 27 in the transport direction X of the medium 100. The second rotary shaft 28 is configured to be rotated in a winding direction C2 by the driving force of a winding motor 29. As the second rotary shaft 28 rotates in the winding direction C2, the medium 100 fed by the second driving roller 26 and the second driven roller 27 is wound around the second rotary shaft 28. In other words, the second rotary shaft 28 is configured to hold a roll body R2 being a roll of the recorded medium 100.

As illustrated in FIG. 1, the control device 50 of the recording device 10 includes a CPU 51, a memory 52, and an ASIC 53. ASIC 53 is an abbreviation for "Application Specific IC". The memory 52 is configured to store programs to be executed by the CPU 51, various maps, calculation results by the CPU 51, values detected by various sensors, and the like. Further, the control device 50 is configured to control the transport device 20 and the record unit 40 to record an image on the recording surface 101 of the medium 100. Note that, the control device 50 may include a plurality of CPUs, and a plurality of functions of the CPU 51 may be distributed to each of the plurality of CPUs. The memory 52 and the ASIC 53 are also the same.

Figure 2:
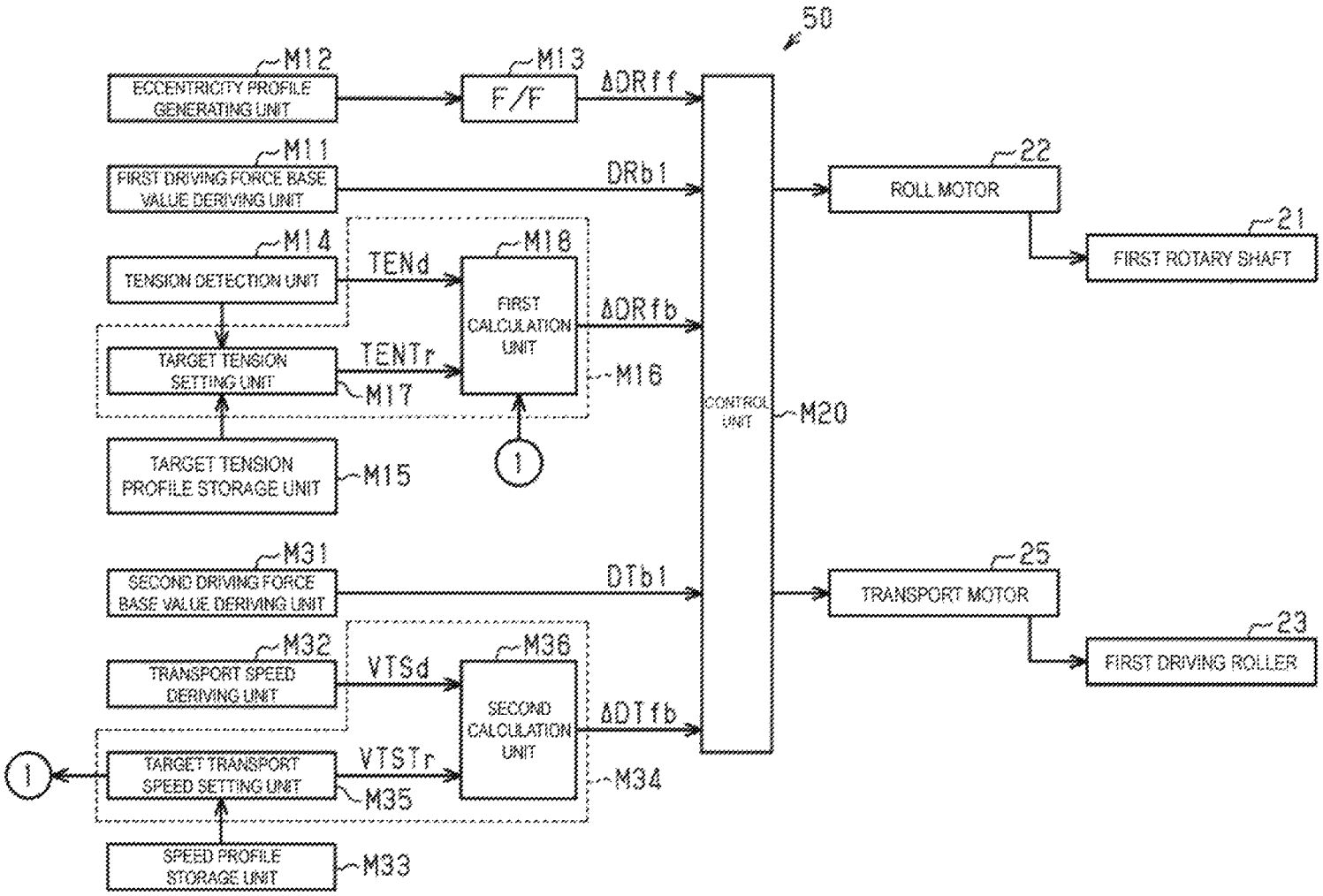
FIG. 2 is a block diagram illustrating a functional configuration of a control device of the recording device.

FIG. 2 illustrates a functional configuration for controlling the roll motor 22 and the transport motor 25 in the control device 50. A first driving force base value deriving unit M11 is configured to derive a base value DRb1 of the driving force by the roll motor 22. For example, the first driving force base value deriving unit M11 is configured to derive, as the base value DRb1, a value that is preset depending on the size of the roll body R1.

As illustrated in FIG. 1, a portion of the medium 100 unwound from the roll body R1 and located between the first rotary shaft 21 and the first driving roller 23 is referred to as a tension adjustment portion 100*a*. In the embodiment, when the medium 100 is transported in the transport direction X, the tension to be applied to the tension adjustment portion 100*a* of the medium 100 is adjusted. Thus, the first driving force base value deriving unit M11 may calculate the base value DRb1 that can give a target value of the tension to be applied to the tension adjustment portion 100*a*.

A tension detection unit M14 is configured to derive, in a predetermined tension detection cycle Ttdc, a detected tension value TENd being a detection value of a tension applied to the tension adjustment portion 100*a* of the medium 100. As the tension applied to the tension adjustment portion 100*a* increases, the load to be applied to the transport motor 25 being the power source for the first driving roller 23 also tends to increase. Furthermore, as the load increases, the load current flowing through the transport motor 25 tends to increase. Thus, the tension detection unit M14 is configured to monitor the load current flowing through the transport motor 25 to derive the detected tension value TENd. In other words, the load current flowing through the transport motor 25 is substantially proportional to the degree of the tension applied to the tension adjustment portion 100*a*. Note that, when a sensor that can directly detect the load applied to the tension adjustment portion 100*a* is provided in the transport device 20, the tension detection unit M14 may calculate the detected tension value TENd based on an output signal of the sensor.

A target tension profile storage unit M15 is an example of a "storage unit", and configured to store a target tension profile PRTen being a transition of a target tension TENTr being a target value of the tension, over time in a predetermined transport cycle Ttc. The transport cycle Ttc refers to a period from a time point at which a transportation of the medium 100 is started to a time point at which the transportation of the medium 100 is stopped. In other words, the first driving roller 23 and the driven roller 24 as the transport unit perform intermittent transport by the transport cycle Ttc. In the intermittent transport, a recording operation by the record unit 40 and a transporting operation by the transport unit are performed alternatively. Further, the transport cycle Ttc is sufficiently longer than the tension detection cycle Ttdc. Therefore, during a single transport cycle Ttc, the tension detection unit M14 derives the detected tension value TENd a plurality of times.

Figure 4:
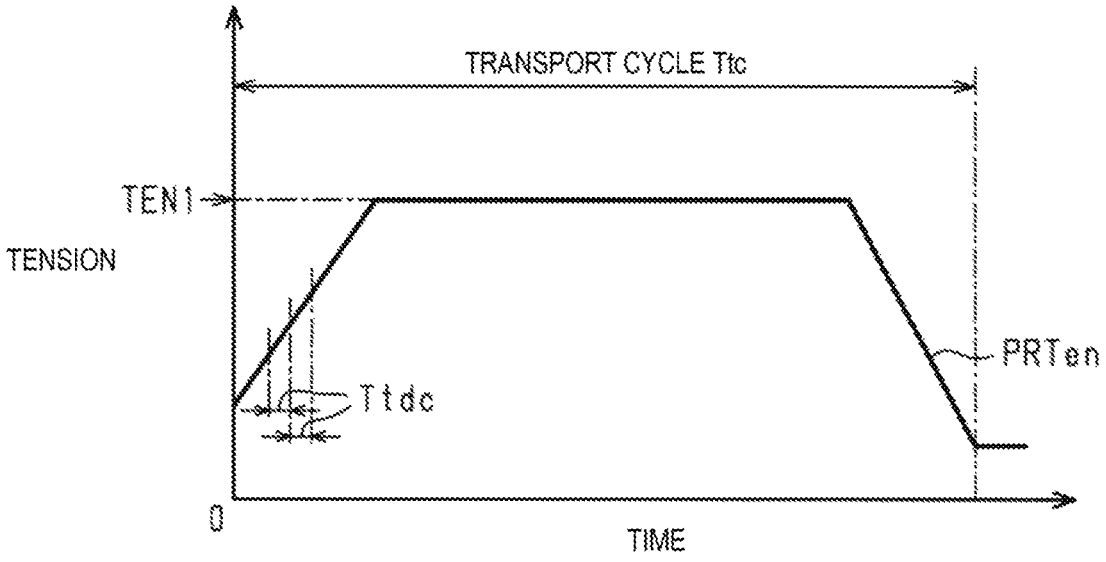
FIG. 4 is a graph of a target tension profile.

FIG. 4 shows an example of the target tension profile PRTen. The target tension profile PRTen represents a transition of the target tension TENTr over time in a single transport cycle Ttc. As shown in FIG. 4, in an initial stage of a single transport cycle Ttc, the target tension TENTr increases. Then, once the target tension TENTr reaches a predetermined value TEN1, the target tension TENTr is kept at the predetermined value TEN1. In addition, in a final stage of the transport cycle Ttc, the target tension TENTr decreases.

Returning to FIG. 2, a tension feedback unit M16 includes a target tension setting unit M17 and a first calculation unit M18. Hereinafter, the tension feedback unit M16 is abbreviated as "tension F/B unit M16".

The target tension setting unit M17 uses the target tension profile PRTen stored in the target tension profile storage unit M15 to set a target tension TENTr. In other words, when the tension detection unit M14 detects the detected tension value TENd for the n-th tension detection cycle Ttdc in the transport cycle Ttc, the target tension setting unit M17 reads out, from the target tension profile PRTen, the target tension TENTr corresponding to the n-th tension detection cycle Ttdc. For example, since the product of "n" and the tension detection cycle Ttdc corresponds to a time in the transport cycle Ttc, the target tension setting unit M17 reads out, from the target tension profile PRTen, the target tension TENTr corresponding to the time. Note that, in each tension detection cycle Ttdc in a single transport cycle Ttc, "n" is incremented by "1". Further, when the transport cycle Ttc ends, the "n" is reset to "0".

For each tension detection cycle Ttdc, the first calculation unit M18 calculates a tension feedback correction amount ΔDRfb by the feedback control based on the deviation between the target tension TENTr set by the target tension setting unit M17 and the detected tension value TENd derived by the tension detection unit M14. Hereinafter, the tension feedback correction amount ΔDRfb is abbreviated as "tension F/B correction amount ΔDRfb". Specifically, the first calculation unit M18 calculates the tension F/B correction amount ΔDRfb by feedback control based on a deviation between the target tension TENTr corresponding to the n-th tension detection cycle Ttdc in the transport cycle Ttc and the detected tension value TENd for the n-th tension detection cycle Ttdc.

In the embodiment, the first calculation unit M18 calculates, as a tension F/B correction amount ΔDRfb, a sum of a proportional element, an integral element, and a differential element, when the deviation between the target tension TENTr and the detected tension value TENd is used as input. The first calculation unit M18 may calculate the tension F/B correction amount ΔDRfb by using only some elements of the proportional element, the integral element, and the differential element.

As described in detail below, the first calculation unit M18 is configured to appropriately change a gain of the feedback control for calculating the tension F/B correction amount ΔDRfb. A method of changing the gain will be described later.

Returning to FIG. 2, an eccentricity profile generating unit M12 is configured to generate an eccentricity profile PREcc of the roll body R1. In other words, the eccentricity profile generating unit M12 performs an eccentricity measurement process for measuring the eccentricity of the roll body R1 held on the first rotary shaft 21. Then, the eccentricity profile generating unit M12 generates the eccentricity profile PREcc based on an eccentricity state of the roll body R1 measured in the eccentricity measurement process.

Here, a case in which the first driving roller 23 and the first driven roller 24 are not eccentric and no slippage occurs between the first driving roller 23 and the medium 100 and between the first driven roller 24 and the medium 100 during transportation of the medium 100 is described. In this case, the transport length of the medium 100 transported in the transport direction X by the first driving roller 23 and the first driven roller 24 per transport cycle Ttc is equal to the length of the medium 100 unwound from the roll body R1 per transport cycle Ttc. Further, when the roll body R1 is not eccentric, the length of the medium 100 unwound from the roll body R1 per transport cycle Ttc is constant. However, when the roll body R1 is eccentric, the length of the medium 100 unwound from the roll body R1 per transport cycle Ttc is constant, but the radius of the roll body R1 may vary in each transport cycle Ttc as the roll body R1 rotates. As a result, the tension adjustment portion 100*a* of the medium 100 may be excessively loosened or strained, resulting in a fluctuation of the degree of tension in the tension adjustment portion 100*a*. In addition, when the radius of the roll body R1 fluctuates cyclically as the roll body R1 rotates, the rotational load applied to the roll motor 22 also fluctuates, and thus, the degree of tension may fluctuate.

Figure 3:
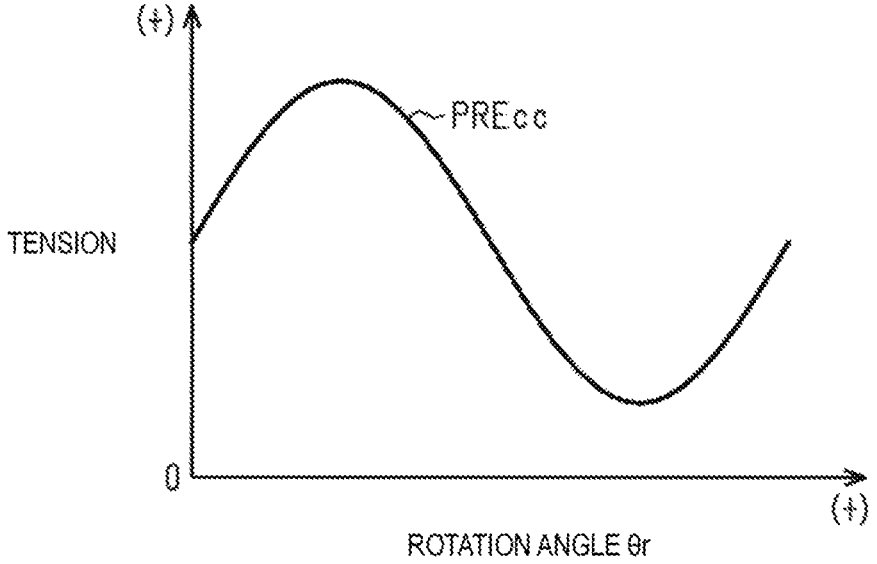
FIG. 3 is a graph of an eccentricity profile.

Thus, in the embodiment, the eccentricity profile PREcc is generated to represent the relationship between a rotation angle θr of the roll body R1 and the load current flowing through the transport motor 25 when the roll body R1 is rotated at a constant speed. In other words, when the roll body R1 is eccentric, the load current flowing through the transport motor 25 fluctuates depending on the change in the rotation angle θr of the roll body R1. Since the load current flowing through the transport motor 25 is proportional to the degree of tension, the relationship between the rotation angle θr of the roll body R1 and the fluctuation in tension can be known based on the eccentricity profile PREcc. FIG. 3 shows an example of an eccentricity profile PREcc. Essentially, the vertical axis in FIG. 3 should be represented as the load current flowing through the transport motor 25. However, as described above, the load current flowing through the transport motor 25 is substantially proportional to tension, so the vertical axis in FIG. 3 represents tension. The eccentricity measurement process will be described in detail later.

Returning to FIG. 2, a tension feedforward unit M13 utilizes the eccentricity profile PREcc generated by the eccentricity profile generating unit M12. Hereinafter, the tension feedforward unit M13 is abbreviated as "tension F/F unit M13". Based on the eccentricity profile PREcc, when there is a likelihood of increase in tension, the tension F/F unit M13, for example, sets a tension feedforward correction amount ΔDRff to a smaller value as compared to when there is no likelihood of increase in tension. Hereinafter, the tension feedforward correction amount ΔDRff is abbreviated as "tension F/F correction amount ΔDRff". Note that details of the calculation process for the tension F/F correction amount ΔDRff by the tension F/F unit M13 will be described later.

In the following description, the tension in the tension adjustment portion 100*a* is simply referred to as tension.

A control unit M20 is configured to calculate a driving force DR by the roll motor 22 based on the base value DRb1 derived by the first driving force base value deriving unit M11, the tension F/F correction amount ΔDRff calculated by the tension F/F unit, and the tension F/B correction amount ΔDRfb calculated by the tension F/B unit M16. In other words, the control unit M20 calculates the driving force DR using the following relational equation (Equation 1). Further, the control unit M20 controls the roll motor 22 based on the calculated driving force DR.

$$DR = DRb1 + \Delta DRff + \Delta DRfb \quad \text{(Equation 1)}$$

In the relational equation (Equation 1), "DRb1+ΔDRff" is the driving force including the results of the feedforward control. When that driving force cannot eliminate the divergence between the detected tension value TENd and the target tension TENTr, "ΔDRfb" is added. Thus, the calculation result of the above-described relational equation (Equation 1) is obtained as the driving force DR. In other words, a value including both of the results of the feedforward control and the feedback control is obtained as the driving force DR.

A second driving force base value deriving unit M31 is configured to derive a base value DTb1 of the driving force by the transport motor 25. For example, the second driving force base value deriving unit M31 derives a preset value as the base value DTb1.

As illustrated in FIG. 1, a portion of the medium 100 between the first driving roller 23 and the second driving roller 26 is referred to as a speed adjustment portion 100*b* of the medium 100. In the embodiment, when the medium 100 is transported in the transport direction X, the transport speed of the speed adjustment portion 100*b* of the medium 100 is adjusted. Thus, the second driving force base value deriving unit M31 may calculate the base value DRb1 that can give a target value of the transport speed in the speed adjustment portion 100*b*. Hereinafter, the transport speed in the speed adjustment portion 100*b* is simply referred to as the transport speed.

Returning to FIG. 2, a transport speed deriving unit M32 is configured to calculate the rotational speed Vtm of the output shaft of the transport motor 25 based on an output signal of the speed sensor 61. The transport speed of the speed adjustment portion 100*b* of the medium 100 tends to increase as the rotational speed Vtm of the output shaft of the transport motor 25 increases. Thus, the transport speed deriving unit M32 derives a detected transport speed value VTSd such that the detected transport speed value VTSd of the speed adjustment portion 100*b* increases, as the calculated rotational speed Vtm of the output shaft of the transport motor 25 increases.

In the embodiment, the transport speed deriving unit M32 is configured to derive, in a predetermined speed detection cycle Tsdc, a detected transport speed value VTSd, and the speed detection cycle Tsdc is shorter than a single transport cycle Ttc. The speed detection cycle Tsdc is shorter than the tension detection cycle Ttdc described above.

A speed profile storage unit M33 is configured to store a speed profile PRV being a transition of a target transport speed VTSTr over time in a single transport cycle Ttc.

Figure 5:
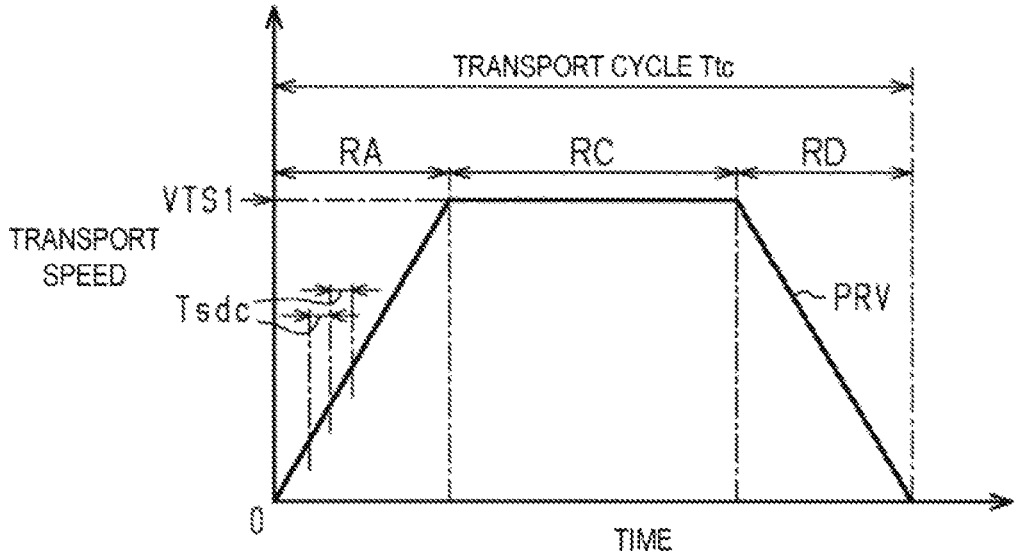
FIG. 5 is a graph of a target transport speed profile.

FIG. 5 shows an example of the speed profile PRV. As shown in FIG. 5, the speed profile PRV includes an acceleration segment RA, a constant speed segment RC, which is a segment following the acceleration segment RA, and a deceleration segment RD, which is a segment following the constant speed segment RC. The acceleration segment RA is a segment where the transport speed of the medium 100 increases over time. The constant speed segment RC is a segment where the transport speed of the medium 100 is constant over time. In the constant speed segment RC, the transport speed may not be strictly constant as long as the transport speed of the medium 100 is substantially constant over time. The deceleration segment RD is a segment where the transport speed of the medium 100 decreases over time.

Note that the acceleration segment RA may include a segment corresponding to a certain period of time after the target transport speed VTSTr has been kept at a predetermined speed VTS1. In other words, the acceleration segment RA may be considered to include a segment corresponding to a certain period of time before the detected transport speed value VTSd converges to the predetermined speed VTS1 by execution of the feedback control. In this case, the length of the period from when the target transport speed VTSTr reaches the predetermined speed VTS1 to when the detected transport speed value VTSd converges to the predetermined speed VTS1 is preset based on experimentation, simulation, or the like.

Returning to FIG. 2, a speed feedback unit M34 includes a target transport speed setting unit M35 and a second calculation unit M36. Hereinafter, the speed feedback unit M34 is abbreviated as "speed F/B unit M34".

The target transport speed setting unit M35 uses the speed profile PRV stored in the speed profile storage unit M33 to set the target transport speed VTSTr. In other words, when the transport speed deriving unit M32 derives the detected transport speed value VTSd in the m-th speed detection cycle Tsdc in the transport cycle Ttc, the target transport speed setting unit M35 reads out, from the speed profile PRV, the target transport speed VTSTr corresponding to the m-th speed detection cycle Tsdc. For example, since the product of "m" and the speed detection cycle Tsdc corresponds to a time in the transport cycle Ttc, the target transport speed setting unit M35 reads out, from the speed profile PRV, the target transport speed VTSTr corresponding to the time. Note that, in each speed detection cycle Tsdc in a single transport cycle Ttc, "m" is incremented by "1". Further, when the transport cycle Ttc ends, "m" is reset to "0".

In each transport cycle Ttc, the second calculation unit M36 calculates a speed feedback correction amount ΔDTfb by the feedback control based on the deviation between the target transport speed VTSTr set by the target transport speed setting unit M35 and the detected transport speed value VTSd derived by the transport speed deriving unit M32. Hereinafter, the speed feedback correction amount ΔDTfb is abbreviated as "speed F/B correction amount ΔDTfb". Specifically, the second calculation unit M36 calculates the speed F/B correction amount ΔDTfb by feedback control based on a deviation between the target transport speed VTSTr corresponding to the m-th speed detection cycle Tsdc in the transport cycle Ttc and the detected transport speed value VTSd in the m-th speed detection cycle Tsdc.

In the embodiment, the second calculation unit M36 calculates, as the speed F/B correction amount ΔDTfb, a sum of a proportional element, an integral element, and a differential element, when the deviation between the target transport speed VTSTr and the detected transport speed value VTSd is used as input. The second calculation unit M36 may calculate the speed F/B correction amount ΔDTfb by using only some elements of the proportional element, the integral element, and the differential element.

The control unit M20 calculates a driving force DT by the transport motor 25 based on the base value DTb1 derived by the second driving force base value deriving unit M31 and the speed F/B correction amount ΔDTfb calculated by the speed F/B unit M34. In other words, the control unit M20 uses the following relational equation (Equation 2) to calculate the driving force DT. Further, the control unit M20 controls the transport motor 25 based on the calculated driving force DT.

$$DT=DTb1+\Delta DTfb \quad \text{(Equation 2)}$$

Figure 6:
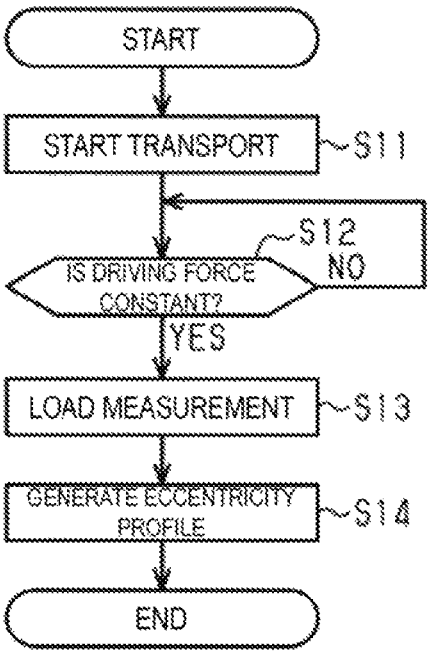
FIG. 6 is a flow chart illustrating an eccentricity measurement process.

Next, the eccentricity measurement process to be performed by the eccentricity profile generating unit M12 of the control device 50 will be described with reference to FIG. 6. The eccentricity measurement process is performed when a predetermined execution condition, including when recording is not performed on the medium 100, is satisfied.

In a first step S11 of the eccentricity measurement process, the transport device 20 is actuated to start transport of the medium 100. In a following step S12, it is determined whether the driving force being output from the roll motor 22 is constant. When the driving force being output from the roll motor 22 is still fluctuating, it is not determined that the driving force being output from the roll motor 22 is constant. Further, when it is not determined that the driving force is constant (S12: NO), the determination of step S12 is repeated. On the other hand, when it is determined that the driving force is constant (S12: YES), the process proceeds to the next step S13.

In step S13, fluctuation in tension due to eccentricity is measured. Specifically, when an amount of the medium 100 unwound from the roll body R1 per transport cycle Ttc by the first driving roller 23 and the first driven roller 24 is constant, the load current flowing through the transport motor 25 is measured at each rotation angle θr of the roll body R1. When the tension adjustment portion 100*a* of the medium 100 is not slackened, the amount of the medium 100 unwound from the roll body R1 by the first driving roller 23 and the first driven roller 24 is equal to the amount of the medium 100 to be transported per transport cycle Ttc. Accordingly, step S13 is preferably performed when the tension adjustment portion 100*a* of the medium 100 is not slackened. As a result, fluctuation in the rotational load applied to the roll motor 22 due to the eccentricity is more correctly reflected in the load current flowing through the transport motor 25, resulting in improving the measuring accuracy. Such measurements are performed at a plurality of rotation angles θr to measure a transition in the load current flowing through the transport motor 25. Then, once the load at each of the rotation angles θr is acquired, the process proceeds to the next step S14. In step S14, the eccentricity profile PREcc is generated. Specifically, the tension tends to increase, as the load current flowing through the transport motor 25 increases. Thus, the eccentricity profile generating unit M12 measures the relationship between the rotation angle θr of the roll body R1 and the load current flowing through the transport motor 25 at a plurality of points to generate an eccentricity profile PREcc. Further, once the eccentricity profile PREcc is generated, the eccentricity measurement process ends.

Note that a current sensor (not illustrated) can be used as a means for measuring the load current. Note that, a known means such as an electrical resistance type device and a magnetic type device can be used as the current sensor, for example.

Figure 7:
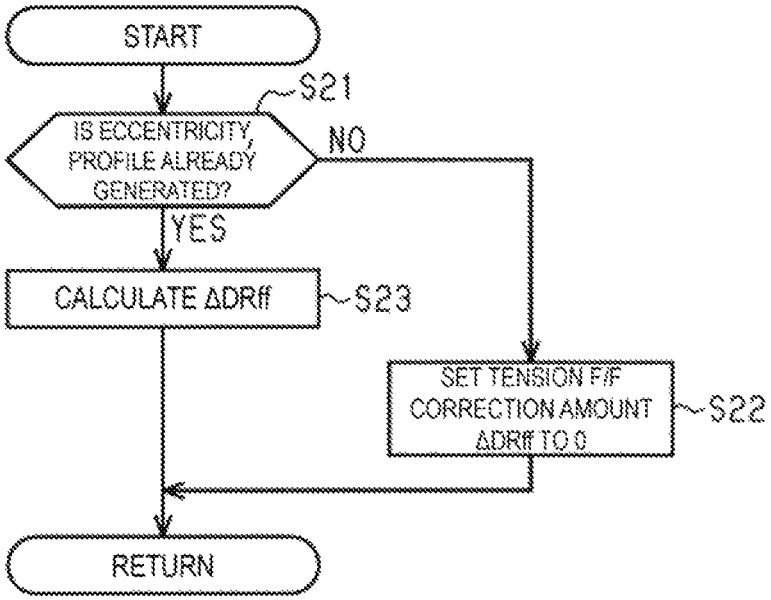
FIG. 7 is a flow chart illustrating a processing routine performed in calculation of a tension feedforward correction amount.

Next, a processing routine to be performed by the tension F/F unit M13 of the control device 50 to calculate the tension F/F correction amount ΔDRff will be described with reference to FIG. 7. This processing routine is repeatedly performed in each tension detection cycle Ttdc when the medium 100 is transported by the transport device 20.

In a first step S21 of the processing routine, it is determined whether the eccentricity profile generating unit M12 has generated the eccentricity profile PREcc. When it is not determined that the eccentricity profile PREcc has been generated (S21: NO), the process proceeds to the next step S22. In step S22, the tension F/F correction amount ΔDRff is set to "0". The processing routine is then terminated for the present.

On the other hand, when it is determined that the eccentricity profile PREcc has been generated (S21: YES), the process proceeds to the next step S23. In step S23, the tension F/F correction amount ΔDRff is calculated. In other words, the tension F/F unit M13 acquires the current rotation angle θr of the roll motor 22, and reads out a tension corresponding to the acquired rotation angle θr from the eccentricity profile PREcc. Further, the tension F/F unit M13 calculates the tension F/F correction amount ΔDRff such that the smaller read-out tension results in a greater tension F/F correction amount ΔDRff, for example. Then, the processing routine is terminated for the present.

Figure 8:
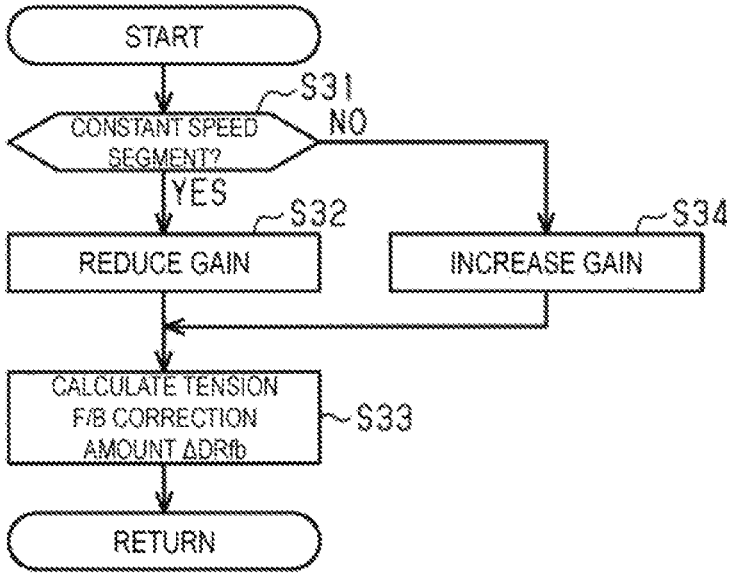
FIG. 8 is a flow chart illustrating a processing routine performed in calculation of a tension feedback correction amount.

Next, a processing routine to be performed by the first calculation unit M18 of the control device 50 to calculate the tension F/B correction amount ΔDRfb will be described with reference to FIG. 8. This processing routine is repeatedly performed in each tension detection cycle Ttdc when the medium 100 is transported by the transport device 20.

In a first step S31 of the processing routine, it is determined whether or not the constant speed segment RC is selected from among the segments RA, RC, and RD in the speed profile PRV in calculation of the speed F/B correction amount ΔDTfb. In other words, when the speed F/B unit M34 performs the feedback control based on the target transport speed VTSTr in the constant speed segment RC in the speed profile PRV, the first calculation unit M18 determines that the constant speed segment RC is selected. On the other hand, when the speed F/B unit M34 performs the feedback control based on the target transport speed VTSTr in the acceleration segment RA or the deceleration segment RD, the first calculation unit M18 does not determine that the constant speed segment RC is selected.

When it is determined that the constant speed segment RC is selected (S31: YES), the process proceeds to a next step S32. In step S32, the gain of the feedback control for calculating the tension F/B correction amount ΔDRfb is set to a smaller value as compared to when it is not determined that the constant speed segment RC is selected. Then, the process proceeds to a next step S33. In step S33, the set gain is used to calculate the tension F/B correction amount ΔDRfb by feedback control based on the deviation between the target tension TENTr and the detected tension value TENd. Then, the processing routine is terminated for the present.

On the other hand, when it is not determined that the constant speed segment RC is selected (S31: NO), it can be determined that a segment other than the constant speed segment RC is selected, and thus, the process proceeds to a next step S34. In step S34, the gain of the feedback control for calculating the tension F/B correction amount ΔDRfb is set to a larger value as compared to when it is determined that the constant speed segment RC is selected. Then, the process proceeds to step S33. In step S33, the set gain is used to calculate the tension F/B correction amount ΔDRfb by feedback control based on the deviation between the target tension TENTr and the detected tension value TENd. Then, the processing routine is terminated for the present.

Note that the gain in the embodiment includes a proportional gain used in calculation of a proportional element, an integral gain used in calculation of an integral element, and a differential gain used in calculation of a differential element. As the proportional gain increases, the absolute value of the proportional element increases. As the integral gain increases, the integral element increases. As the differential gain increases, the differential element increases. When different gains are used based on the type of the segment, i.e., the acceleration segment RA, the constant speed segment RC, or the deceleration segment RD, any of the proportional gain, the integral gain, and the differential gain may be changed, or some of the gains may be changed while the other gain(s) may not be changed.

Figure 9:
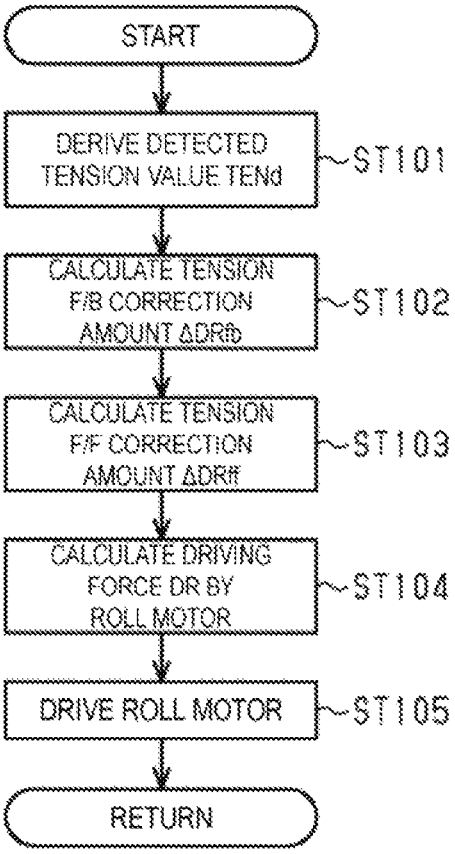
FIG. 9 is a flow chart illustrating a medium transport method according to the embodiment.

Next, a medium transport method in the recording device 10 will be described with reference to FIG. 9. In the embodiment, steps included in the medium transport method are performed by the control device 50. As illustrated in FIG. 9, in step ST101, a detected tension value TENd being a tension applied to the tension adjustment portion 100*a* of the medium 100 is derived. Further, in step ST102, the tension F/B correction amount ΔDRfb is calculated by feedback control based on the deviation between the target tension TENTr and the detected tension value TENd. Further, in step ST103, the tension F/F correction amount ΔDRff is calculated by the feedforward control based on the eccentricity profile PREcc. Further, in step ST104, the driving force DR by the roll motor 22 is calculated based on the calculated tension F/B correction amount ΔDRfb and the tension F/F correction amount ΔDRff. Further, in step ST105, the roll motor 22 is driven based on the calculated driving force DR.

The steps ST101 to ST105 are performed in each tension detection cycle Ttdc shorter than the transport cycle Ttc.

The operations and effects of the embodiment will now be described.

(1) The tension F/B correction amount ΔDRfb is calculated by feedback control based on the target tension TENTr and the detected tension value TENd in each tension detection cycle Ttdc is shorter than the transport cycle Ttc. Further, the driving force DR by the roll motor 22 is calculated based on the tension F/B correction amount ΔDRfb, and the roll motor 22 is controlled based on that driving force DR. As a result, it is possible to reduce, in the transport cycle Ttc, divergence between the target tension TENTr and a tension applied to the tension adjustment portion 100*a* of the medium 100.

(2) In the embodiment, as illustrated in FIG. 4, the target tension TENTr varies within the transport cycle Ttc. Thus, when the detected tension value TENd is detected in the n-th tension detection cycle Ttdc in the transport cycle Ttc, the target tension TENTr corresponding to the n-th tension detection cycle Ttdc is read out. Further, the tension F/B correction amount ΔDRfb is calculated by feedback control based on the deviation between the read-out target tension TENTr and the detected tension value TENd in the n-th tension detection cycle Ttdc. Then, the driving force DR by the roll motor 22 is calculated based on the tension F/B correction amount ΔDRfb.

Thus, even when the target tension TENTr varies within the transport cycle Ttc, it is possible to set the driving force DR by the roll motor 22 to a value in which the variation of the target tension TENTr is taken into account. Further, based on the driving force DR obtained by the calculation, the roll motor 22 is controlled. As a result, even when the target tension TENTr varies in the transport cycle Ttc, it is possible to reduce divergence between the target tension TENTr and a tension applied to the tension adjustment portion 100*a* of the medium 100.

(3) In the embodiment, the eccentricity state of the roll body R1 held on the first rotary shaft 21 is acquired in the eccentricity measurement process, and the eccentricity profile PREcc is generated. After the eccentricity profile PREcc is generated, feedforward control based on the eccentricity profile PREcc is performed to calculate the tension F/F correction amount ΔDRff. Further, the driving force DR by the roll motor 22 is calculated based on the tension F/F correction amount ΔDRff and the tension F/B correction amount ΔDRfb, and the roll motor 22 is controlled based on the driving force DR. In this case, the correction delay of the driving force DR can be suppressed compared to when feedback control is performed without performing the feedforward control. As a result, the adjustment accuracy of the tension applied to the tension adjustment portion 100*a* of the medium 100 can be improved.

(4) In the eccentricity measurement process, fluctuation in the load applied to the roll motor 22 are monitored while the roll body R1 is rotated at a constant speed. Specifically, when an amount of the medium 100 unwound from the roll body R1 per transport cycle Ttc by the first driving roller 23 and the first driven roller 24 is constant, the load current flowing through the transport motor 25 is measured at each rotation angle θr. Further, based on the relationship between the rotation angle θr and the load current obtained in the measurement, the eccentricity profile PREcc is generated. As a result, it is possible to generate the eccentricity profile PREcc based on the eccentricity state of the roll body R1.

(5) In the embodiment, the driving force DT by the transport motor 25 is calculated based on the speed F/B correction amount ΔDTfb calculated by the feedback control based on the target transport speed VTSTr and the detected transport speed value VTSd of the medium 100. Further, the transport motor 25 is controlled based on this driving force DT. Thus, even when the degree of tension applied to the tension adjustment portion 100*a* of the medium 100 fluctuates, it is possible to reduce divergence between the target transport speed VTSTr and the transport speed of the medium 100 in a region downstream from the first driving roller 23 and the first driven roller 24 in the transport direction X. By appropriately controlling the transport speed of the speed adjustment portion 100*b* of the medium 100 in this way, recording accuracy of the image recorded onto the recording surface 101 of the medium 100 can be improved.

(6) When the calculation result of the feedback control based on the target transport speed VTSTr in the acceleration segment RA of the speed profile PRV is used to control the transport motor 25, the tension applied to the tension adjustment portion 100*a* of the medium 100 tends to increase, for example. Furthermore, when the calculation result of the feedback control based on the target transport speed VTSTr in the deceleration segment RD of the speed profile PRV is used to control the transport motor 25, the tension applied to the tension adjustment portion 100*a* tends to decrease, for example. In other words, when the calculation result of the feedback control based on the target transport speed VTSTr in a segment of the speed profile PRV other than the constant speed segment RC is used to control the transport motor 25, the tension applied to the tension adjustment portion 100*a* tends to fluctuate. On the other hand, when the calculation result of the feedback control based on the target transport speed VTSTr in the constant speed segment RC of the speed profile PRV is used to control the transport motor 25, the tension applied to the tension adjustment portion 100*a* tends to be constant.

Therefore, in the embodiment, it can be supposed that, when the calculation result of the feedback control based on the target transport speed VTSTr in a segment other than the constant speed segment RC is used to control the transport motor 25, the tension applied to the tension adjustment portion 100*a* tends to fluctuate. Thus, the gain of the feedback control for calculating the tension F/B correction amount ΔDRfb increases. As a result, even when there is a likelihood that tension applied to the tension adjustment portion 100*a* fluctuates, it is possible to reduce divergence between the target tension TENTr and a tension applied to the tension adjustment portion 100*a*.

On the other hand, it can be supposed that, when the calculation result of the feedback control based on the target transport speed VTSTr in the constant speed segment RC is used to control the transport motor 25, the tension applied to the tension adjustment portion 100*a* tends to be constant. Thus, the gain of the feedback control for calculating the tension F/B correction amount ΔDRfb decreases. As a result, it is possible to easily keep a state in which the detected tension value TENd converges to the target tension TENTr. In other words, the tension applied to the tension adjustment portion 100*a* can be controlled with high accuracy.

(7) In the embodiment, fluctuation in a tension applied to the tension adjustment portion 100*a* of the medium 100 is suppressed, and thus, fluctuation in the transport speed of the speed adjustment portion 100*b* of the medium 100 can be suppressed. As a result, it is possible to suppress deterioration in quality of an image recorded on the medium 100.

Note that, the embodiments described above may be modified as follows.

- In the above embodiment, the gain of the feedback control for calculating the tension F/B correction amount ΔDRfb is changed as appropriate, but the gain may not be changed.
- The control for the transport motor 25 may not use the calculation result of the feedback control based on the target transport speed VTSTr.
- The speed detection cycle Tsdc may not necessarily be shorter than the tension detection cycle Ttdc, as long as the speed detection cycle Tsdc is shorter than the transport cycle Ttc. For example, the speed detection cycle Tsdc may have the same length as the tension detection cycle Ttdc or may be longer than the tension detection cycle Ttdc.
- The eccentricity profile PREcc may not be a profile representing a relationship between the rotation angle θr and the tension as long as the eccentricity profile PREcc can represent an eccentricity state of the roll body R1. For example, the eccentricity profile PREcc may be a profile representing a relationship between the rotation angle θr and the load applied to the roll motor 22.
- The eccentricity profile PREcc may be generated by using a method different from the method described in the above-described embodiment, as long as the eccentricity profile PREcc can be generated. For example, the degree of eccentricity with respect to the rotation angle θr may be measured by using an optical sensor, instead of measuring the load current flowing through the transport motor 25, to generate the eccentricity profile PREcc based on the geometry of the roll body R1.
- In the calculation of the driving force DR by the roll motor 22, the feedforward control may not be performed, as long as the feedback control is performed.
- The recording device may be another type of printer different from the serial scan type printer illustrated in FIG. 1, as long as ink droplets can land on the speed adjustment portion 100*b* of the medium 100. For example, the recording device may be a line printer in which a line printing method is adopted. A record unit of the recording device using the line printing method includes a line head having an elongated shape slightly longer than the maximum width of the medium 100, in the width direction intersecting the transport direction X.
- The medium 100 may be a medium other than roll paper, as long as the medium can be wound to form a roll. Examples of media other than roll paper include films or sheets made of synthetic resin, cloth, nonwoven fabrics, or laminate sheets.
- The recording device 10 is not limited to a recording device using drop discharging such as an ink-jet type device, and may be a dot impact type device or an electrophotographic device.

Hereinafter, technical ideas that are understood from the above embodiments and modifications will be described in connection with the effects.

A transport device includes a holding unit configured to rotatably hold a roll body formed by winding a medium, a rotary driving unit configured to impart, to the holding unit, a driving force in a rotation direction of the roll body, a transport unit disposed downstream from the holding unit in a transport direction of the medium, the transport unit being configured to feed, downstream in the transport direction and for each predetermined transport cycle, the medium unwound from the roll body, a transport driving unit configured to drive the transport unit, a control unit configured to control the rotary driving unit and the transport driving unit, a tension detection unit configured to derive, for each tension detection cycle that is shorter than the transport cycle, a detected tension value that is a tension applied to a portion of the medium between the holding unit and the transport unit, and a tension feedback unit configured to calculate, each time the detected tension value is detected, a tension feedback correction amount by feedback control based on a deviation between the detected tension value and a target tension that is a target value of the detected tension value. In the transport device, the control unit is configured to calculate, for each tension detection cycle, a driving force by the rotary driving unit based on the tension feedback correction amount to control the rotary driving unit based on the driving force by the rotary driving unit.

According to the above-described configuration, for each tension detection cycle shorter than the predetermined transport cycle, the tension feedback correction amount is calculated by feedback control based on the target tension and the detected tension value. Further, the driving force by the rotary driving unit is calculated based on the tension feedback correction amount, and the rotary driving unit is controlled based on that driving force. As a result, it is possible to reduce, in the transport cycle, divergence between the target tension and a tension applied to the portion of the medium between the holding unit and the transport unit.

The above-described transport device may include a storage unit configured to store a transition of the target tension in the transport cycle, and when n is a natural number equal to or greater than 1 and corresponds to an ordinal number of the tension detection cycle, the tension feedback unit may be configured to, when the tension detection unit derives the detected tension value for n tension detection cycle in the transport cycle, read out, from the storage unit, the target tension corresponding to the n tension detection cycle, and calculate the tension feedback correction amount by feedback control based on a deviation between the detected tension value for the n tension detection cycle and the target tension that is read out from the storage unit.

According to the above-described configuration, even when the target tension varies within the transport cycle, it is possible to set the driving force by the rotary driving unit to a value in which the variation of the target tension is taken into account. Further, based on the driving force obtained by the calculation, the rotary driving unit is controlled. As a result, even when the target tension varies in the transport cycle, it is possible to reduce divergence between the target tension and a tension applied to the portion of the medium between the holding unit and the transport unit.

Note that "n" is a natural number equal to or greater than "1". In other words, in each tension detection cycle in a single transport cycle, "n" is incremented by "1". Further, when the transport cycle ends, "n" is reset to "0".

The above-described transport device may include an eccentricity profile generating unit configured to perform an eccentricity measurement process for measuring eccentricity of the roll body held by the holding unit, and the eccentricity profile generating unit configured to generate an eccentricity profile based on an eccentricity state of the roll body measured in the eccentricity measurement process, and a tension feedforward unit configured to calculate, for each tension detection cycle, a tension feedforward correction amount by feedforward control based on the eccentricity profile generated by the eccentricity profile generating unit, and the control unit may be configured to calculate, for each tension detection cycle, a driving force by the rotary driving unit based on the tension feedback correction amount and the tension feedforward correction amount to control the rotary driving unit based on the driving force by the rotary driving unit.

The roll body held by the holding unit may be eccentric. Even when an amount of the medium unwound from the roll body per transport cycle, i.e. the amount of medium transported per transport cycle, is constant, such an eccentric roll body may lead to a fluctuation in tension due to a fluctuation in the load applied to the rotary driving unit, for example.

According to the above-described configuration, the eccentricity measurement process is performed to generate an eccentricity profile based on an eccentricity state of the roll body. Further, when the eccentricity profile is generated, feedforward control based on the eccentricity profile is performed to calculate the tension feedforward correction amount. The driving force by the rotary driving unit is calculated based on the tension feedforward correction amount and the tension feedback correction amount, and the rotary driving unit is controlled based on the driving force. In this case, the correction delay of the driving force by the rotary driving unit can be suppressed compared to when feedback control is performed without performing the feedforward control.

In the above-described transport device, in the eccentricity measurement process, the eccentricity profile generating unit may be configured to generate the eccentricity profile based on a transition of load current flowing in the transport driving unit with respect to a change in a rotation angle of the roll body, in a state where the rotary driving unit outputs a constant driving force substantially and a transport amount of the medium for each transport cycle is constant substantially.

Even when an amount of the medium unwound from the roll body per transport cycle, i.e. the amount of the medium transported per transport cycle, is constant, an eccentric roll body may lead to a fluctuation in tension due to a fluctuation in the load applied to the rotary driving unit, for example. According to the above-described configuration, an eccentricity profile can be generated based on a transition in the load current flowing through the transport driving unit when the roll body is rotated at a constant speed. Accordingly, it is possible to indirectly measure fluctuations in the load applied to the rotary driving unit based on the load current flowing through the transport driving unit without using a tension sensor or the like for measuring tension fluctuations. As a result, it is possible to generate, by using a simple configuration, the eccentricity profile based on the eccentricity state of the roll body.

The above-described transport device may include a transport speed deriving unit configured to derive, in a speed detection cycle that is shorter than the transport cycle, the detected transport speed value being a transport speed of the medium fed downstream in the transport direction by the transport unit, and a speed feedback unit configured to calculate a speed feedback correction amount by feedback control based on a deviation between a target transport speed being a target value of the transport speed of the medium, and the detected transport speed value derived by the transport speed deriving unit, and the control unit may be configured to calculate, for each speed detection cycle, a driving force by the transport driving unit based on the speed feedback correction amount to control the transport driving unit based on the driving force by the transport driving unit.

According to the above-described configuration, the driving force by the transport driving unit is calculated based on the speed feedback correction amount calculated by the feedback control based on the target transport speed and the detected transport speed value of the medium, and the transport driving unit is controlled based on the driving force. Thus, even when the degree of tension applied to the portion of the medium between the holding unit and the transport unit fluctuates, it is possible to reduce divergence between the target transport speed and the transport speed of the medium in a region downstream from the transport unit in the transport direction.

The above-described transport device may include a speed profile storage unit configured to store a speed profile being a transition in the target transport speed over time in the transport cycle, the speed feedback unit may be configured to read out, from the speed profile stored in the speed profile storage unit, the target transport speed corresponding to a time in the transport cycle, the speed profile may include an acceleration segment in which the transport speed of the medium increases over time substantially, a constant speed segment following the acceleration segment, the transport speed of the medium being constant over time substantially, and a deceleration segment following the constant speed segment, the transport speed of the medium decreasing over time substantially, and the tension feedback unit may be configured to, when the speed feedback unit performs feedback control based on the target transport speed in the constant speed segment of the speed profile, reduce a gain of feedback control for calculating the tension feedback correction amount, as compared to when the speed feedback unit performs feedback control based on the target transport speed in a segment other than the constant speed segment of the speed profile.

When the calculation result of the feedback control based on the target transport speed in the acceleration segment of the speed profile is used to control the drive constant speed segment, the transport speed of the medium decreasing over time in the deceleration segment, the tension applied to the portion of the medium between the holding unit and the transport unit tends to increase, for example. Furthermore, when the calculation result of the feedback control based on the target transport speed in the deceleration segment of the speed profile is used to control the drive constant speed segment, the transport speed of the medium decreasing over time in the deceleration segment, the tension applied to the portion of the medium between the holding unit and the transport unit tends to decrease, for example. In other words, when the calculation result of the feedback control based on the target transport speed in a segment of the speed profile other than the constant speed segment is used to control the drive constant speed segment, the transport speed of the medium decreasing over time in the deceleration segment, the tension applied to the portion of the medium between the holding unit and the transport unit tends to fluctuate. On the other hand, when the calculation result of the feedback control based on the target transport speed in the constant speed segment of the speed profile is used to control the drive constant speed segment, the transport speed of the medium decreasing over time in the deceleration segment, the tension applied to the portion of the medium between the holding unit and the transport unit tends to be constant.

Therefore, according to the above-described configuration, when it can be supposed, based on the control manner of the transport unit, that the tension applied to the portion of the medium between the holding unit and the transport unit is likely to fluctuate, the divergence between the tension applied to that portion and the target tension is likely to increase. Thus, the gain of the feedback control for calculating the tension feedback correction amount increases. As a result, even when there is a likelihood that a tension applied to the portion of the medium between the holding unit and the transport unit fluctuates, it is possible to reduce divergence between the target tension and a tension applied to that portion.

On the other hand, when it can be supposed, based on the control manner of the transport unit, that the tension applied to the portion of the medium between the holding unit and the transport unit is not likely to fluctuate, the divergence between the tension applied to that portion and the target tension is not likely to increase. Thus, the gain of the feedback control for calculating the tension feedback correction amount decreases. As a result, the control performance can be improved.

A recording device may include the above-described transport device, and a recording unit configured to perform recordning onto a portion of the medium to be transported by the transport device, the portion being located downstream from the transport unit in the transport direction.

According to the above-described configuration, a fluctuation in a tension applied to the portion of the medium between the holding unit and the transport unit is suppressed, and thus, a fluctuation in the transport speed of the portion of the medium onto which the recording is performed by the recording unit can be suppressed. As a result, it is possible to suppress deterioration in quality of an image recorded on the medium.

A medium transport method includes providing, a transport device including a holding unit configured to rotatably hold a roll body formed by winding a medium, a rotary driving unit configured to impart, to the holding unit, a driving force in a rotation direction of the roll body, a transport unit disposed downstream from the holding unit in a transport direction of the medium, the transport unit being configured to feed the medium, unwound from the roll body, downstream in the transport direction for each predetermined transport cycle, and a transport driving unit cinfigured to drive the transport unit. The medium transport method further includes deriving, for each tension detection cycle that is shorter than the transport cycle, a detected tension value that is a tension applied to a portion of the medium between the roll body and the transport unit, calculating, each time the detected tension value is derived, a tension feedback correction amount by feedback control based on a deviation between the detected tension value and a target tension that is a target value of the detected tension value, and calculating, for each tension detection cycle, a driving force by the rotary driving unit based on the calculated tension feedback correction amount to drive the rotary driving unit based on the driving force by the rotary driving unit.

The control device of the transport device is caused to perform the above-described medium transport method to achieve the same effects as those of the transport device described above.

What is claimed is:

1. A transport device comprising:

a holding unit configured to rotatably hold a roll body formed by winding a medium;

a rotary driving unit configured to impart, to the holding unit, a driving force in a rotation direction of the roll body;

a transport unit disposed downstream from the holding unit in a transport direction of the medium, the transport unit being configured to feed, downstream in the transport direction and for each predetermined transport cycle, the medium unwound from the roll body;

a transport driving unit configured to drive the transport unit;

a control unit configured to control the rotary driving unit and the transport driving unit;

a tension detection unit configured to derive, for each tension detection cycle that is shorter than the transport cycle, a detected tension value that is a tension applied to a portion of the medium between the holding unit and the transport unit; and a tension feedback unit configured to calculate, each time the detected tension value is detected, a tension feedback correction amount by feedback control based on a deviation between the detected tension value and a target tension that is a target value of the detected tension value, wherein the control unit is configured to calculate, for each tension detection cycle, the driving force by the rotary driving unit based on the tension feedback correction amount to control the rotary driving unit based on the driving force by the rotary driving unit.

2. The transport device according to claim 1, comprising a storage unit configured to store a transition of the target tension in the transport cycle, wherein when n is a natural number equal to or greater than 1 and corresponds to an ordinal number of the tension detection cycle, the tension feedback unit is configured to, when the tension detection unit derives the detected tension value for an n tension detection cycle in the transport cycle, read out, from the storage unit, the target tension corresponding to the n tension detection cycle, and calculate the tension feedback correction amount by feedback control based on a deviation between the detected tension value for the n tension detection cycle and the target tension that is read out from the storage unit.

3. The transport device according to claim 1, comprising:

an eccentricity profile generating unit configured to perform an eccentricity measurement process for measuring eccentricity of the roll body held by the holding unit, and the eccentricity profile generating unit configured to generate an eccentricity profile based on an eccentricity state of the roll body measured in the eccentricity measurement process; and a tension feedforward unit configured to calculate, for each tension detection cycle, a tension feedforward correction amount by feedforward control based on the eccentricity profile generated by the eccentricity profile generating unit, wherein the control unit is configured to calculate, for each tension detection cycle, the driving force by the rotary driving unit based on the tension feedback correction amount and the tension feedforward correction amount to control the rotary driving unit based on the driving force by the rotary driving unit.

4. The transport device according to claim 3, wherein in the eccentricity measurement process, the eccentricity profile generating unit is configured to generate the eccentricity profile based on a transition of a load current flowing in the transport driving unit with respect to a change in a rotation angle of the roll body, in a state where the rotary driving unit outputs a constant driving force substantially and a transport amount of the medium for each transport cycle is constant substantially.

5. The transport device according to claim 1, comprising:

a transport speed deriving unit configured to derive, for each speed detection cycle that is shorter than the transport cycle, a detected transport speed value, the detected transport speed value being a transport speed of the medium fed downstream in the transport direction by the transport unit; and a speed feedback unit configured to calculate a speed feedback correction amount by feedback control based on a deviation between a target transport speed that is a target value of the transport speed of the medium and the detected transport speed value derived by the transport speed deriving unit, wherein the control unit is configured to calculate, for each speed detection cycle, a driving force by the transport driving unit based on the speed feedback correction amount to control the transport driving unit based on the driving force by the transport driving unit.

6. The transport device according to claim 5, comprising a speed profile storage unit configured to store a speed profile that is a transition of the target transport speed over time in the transport cycle, wherein the speed feedback unit is configured to read out, from the speed profile stored in the speed profile storage unit, the target transport speed corresponding to a time in the transport cycle, the speed profile includes an acceleration segment in which the transport speed of the medium increases over time substantially, a constant speed segment that follows the acceleration segment and in which the transport speed of the medium is constant over time substantially, and a deceleration segment that follows the constant speed segment and in which the transport speed of the medium decreases over time substantially, and the tension feedback unit is configured to, when the speed feedback unit performs feedback control based on the target transport speed in the constant speed segment of the speed profile, reduce, as compared to when the speed feedback unit performs feedback control based on the target transport speed in a segment other than the constant speed segment of the speed profile, a gain of feedback control for calculating the tension feedback correction amount.

7. A recording device, comprising:

the transport device according to claim 1; and a recording unit configured to perform recording onto a portion of the medium transported by the transport device, the portion being located downstream from the transport unit in the transport direction.

8. A medium transport method comprising:

providing, a transport device including a holding unit configured to rotatably hold a roll body formed by winding a medium, a rotary driving unit configured to impart, to the holding unit, a driving force in a rotation direction of the roll body, a transport unit disposed downstream from the holding unit in a transport direction of the medium, the transport unit being configured to feed the medium, unwound from the roll body, downstream in the transport direction for each predetermined transport cycle, and a transport driving unit configured to drive the transport unit;

deriving, for each tension detection cycle that is shorter than the transport cycle, a detected tension value that is a tension applied to a portion of the medium between the roll body and the transport unit;

calculating, each time the detected tension value is derived, a tension feedback correction amount by feedback control based on a deviation between the detected tension value and a target tension that is a target value of the detected tension value; and calculating a driving force by the rotary driving unit based on the tension feedback correction amount calculated, to drive the rotary driving unit based on the driving force by the rotary driving unit.

* * * * *